United States Patent [19]

Costerton

[11] 4,419,248

[45] Dec. 6, 1983

[54] BIOFILM REMOVAL

[75] Inventor: John W. F. Costerton, Calgary, Canada

[73] Assignee: Her Majesty the Queen in right of the Province of Alberta, as represented by the Minister of Energy and Natural Resources, Edmonton, Canada

[21] Appl. No.: 365,260

[22] Filed: Apr. 5, 1982

[51] Int. Cl.[3] ..... C02F 1/22

[52] U.S. Cl. ..... 210/764; 134/30; 165/1; 210/766

[58] Field of Search ..... 134/30, 42; 165/1, 134; 210/764, 766, 774, 737

[56] References Cited

U.S. PATENT DOCUMENTS

| | | | |
|---|---|---|---|
| 2,663,165 | 12/1953 | Simpson | 210/764 X |
| 3,745,782 | 7/1973 | Neyhart et al. | 210/774 X |
| 4,143,702 | 3/1979 | Barr | 134/30 |
| 4,208,220 | 6/1980 | White | 134/7 |

*Primary Examiner*—Thomas G. Wyse

*Attorney, Agent, or Firm*—E. P. Johnson

[57] ABSTRACT

A method is provided for removing biofilm from a surface submerged in water. The method includes cooling the biofilm to below the freezing point of water to thereby generate large, sharp-edged ice crystals in the biofilm. The frozen biofilm is then thawed and removed from the surface by, for instance, flowing a liquid across the surface.

10 Claims, 6 Drawing Figures

BIOFILM REMOVAL

FIELD OF THE INVENTION

This invention relates to a method for removing biofilm from a surface submerged in water.

BACKGROUND OF THE INVENTION

In the operation of a vessel or pipe carrying a flow of natural water—such as a heat exchanger—a slimy biofilm will develop on the submerged metal surfaces. This biofilm gradually thickens with time; soon it significantly interferes with heat exchange and the volume of flow which can be accommodated. Also, the biofilm deposit greatly increases the frictional resistance to flow within the fouled pipes. Pumping efficiency through the pipes is therefore significantly reduced.

Over the last few years, the development and nature of the biofilm have been studied and may be described as follows: Individual bacteria cells present in the water generate an outwardly extending mass of polysaccharide fibres. This felt-like mass is termed a "glycocalyx". The fibres function to anchor the cell to the metal surface and also to the glycocalyces of other cells. In time, a complex population of bacteria encapsulated within a matrix of fibres is generated and adheres tenaciously to the submerged surface. A more detailed explanation of the foregoing is given in the article "How Bacteria Stick" by J. W. Costerton, G. G. Geesey and K.-J. Cheng in the January, 1978, issue of Scientific American, Vol. 238, No. 1, pages 86–95.

Most attempts to alleviate this problem have been directed toward removing the biofilm, once it is established on the metal surface.

Recent techniques to remove established biofilm have involved the use of chlorine, biocides or mechanical abrasion. Chlorine works by killing the bacteria and oxidizing the polysaccharides to break the film away from the metal surface. However, while chlorine is effective, its presence in the effluent is environmentally undesirable. The biocides, such as various aldehydes, operate by killing bacteria and thereby reduce the rate of growth of the biofilm. However, it appears that the biocides have difficulty in penetrating the glycocalyx—thus inordinate quantities of the chemicals have to be used to achieve any effect on the biofilm. Mechanical abrasion has been tried by passing 'pigs' or balls, coated with abrasive material, past the surface, to dislodge the biofilm. However, this is a labour intensive and thus expensive technique.

It follows, therefore, that there is a need for a simple and effective way to remove biofilm from a submerged fouled surface in an industrial aquatic system. In the case of a heat exchanger, this will improve or restore heat exchange efficiency and permit free water flow.

Prior art of interest is U.S. Pat. No. 661,873. It describes cooling a boiler inner surface to below the freezing point of water, to thereby contract the metal and expand the scale. This causes the scale to break away from the metal wall. This disclosure is directed to a material differing significantly from biofilm. More particularly, scale is a crystalline mass of insoluble inorganic salts while biofilm is composed of bacterial cells and of their organic products.

SUMMARY OF THE INVENTION

The present invention takes advantage of the fact that the glycocalyx is highly hydrated, to the extent that it is as much as 99% by weight water.

In accordance with the process, the biofilm is cooled, to below the freezing point of water, to thereby convert the contained water into large, sharp-edged ice crystals. The growth of these crystals causes disruption of the glycocalyx, apparently by severing the fibres. Upon subsequent thawing, it is found that the biofilm can be washed away by the shear forces generated by the flowing water.

In a preferred feature of the invention, cooling is conducted slowly, so as to ensure growth of the desired large, sharp-edged crystals. For example, if cooling is conducted at a rate of about 2° to 15° C./min., crystals having a size in the order of 0.5 to 20 μm (units) and sharp edges are generated. These crystals are effective to disrupt the biofilm as desired. By way of contrast, if cooling is conducted too rapidly, for example at more than 20° C./min., then an ice "glass" is produced in which individual crystals cannot be resolved by electron microscopy, and biofilm removal is greatly decreased.

In another preferred feature, cooling is conducted internally of the heat exchanger by contacting the biofilm with a liquid coolant which freezes the water in the biofilm without displacing it. Exemplary coolants include aqueous solutions of dextran or ethylene glycol.

Broadly stated, the invention is a method for removing biofilm from a submerged fouled surface in an industrial aquatic conduit, comprising bacteria associated with glycocalyx containing water, said biofilm being adherent to the surface. The method comprises: cooling the biofilm to below the freezing point of water to thereby generate large sharp-edged ice crystals; thawing the frozen biofilm; and then removing at least part of the biofilm from the surface.

DESCRIPTION OF THE PREFERRED EMBODIMENT

Figure 1:
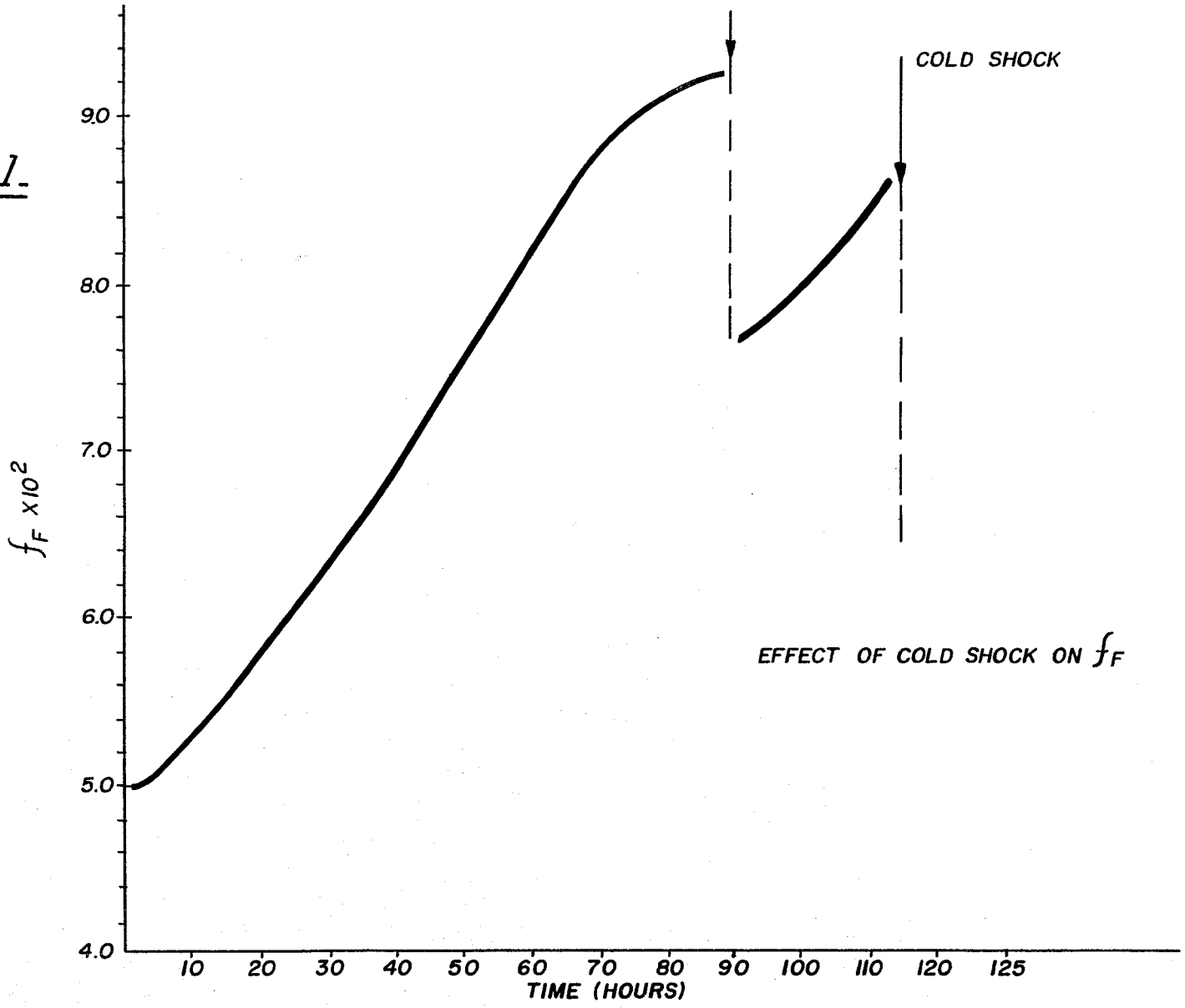
FIG. 1 is a graph illustrating the frictional resistance ($f_F$) to water flow through a fouled length of tubing before and after the freeze-thaw process of this invention.

The biofilm removal process of this invention finds particular application with the fouled pipes of a heat exchanger, however, it may also be practiced on other biofilm fouled surfaces.

To remove biofilm from a fouled surface, in accordance with this process, the operator must freeze the contained water of the biofilm sufficiently slowly that large ice crystals are formed within the biofilm polysaccharide matrix. The formation of large, for instance 0.5 to 20 μm, sharp-edged ice crystals shears the matrix fibres of the biofilm and renders the biofilm removable by the normal forces of fluid flow over the surface.

The method used to freeze the fouled surface depends on the environment of the fouled surface. For fouled pipe surfaces which lend themselves to external cooling, the pipe may be packed with a freezing medium, for instance dry ice or liquid nitrogen. While freezing is more easily, and usually more economically, accomplished in the absence of flow over the fouled surface, freezing might also be applied to flowing systems. The time needed to freeze the biofilm contained water in a flowing system is increased, especially if a large reservoir of water is being circulated through the fouled pipes. Freezing rates of about 2° C. to 15° C./min. are optimal for the formation of large, sharp-edged ice crystals.

In a more complex fouled structure such as a heat exchanger, in which external cooling is not practical, sufficient internal cooling can be obtained by contacting the fouled surface with a liquid coolant. The coolant used is a liquid which does not itself freeze at the temperatures needed to freeze the biofilm water, and which does not displace the water from the biofilm. One such coolant is an aqueous solution of dextran. Dextrans are relatively high molecular weight polymers of D-glucose and are available in large or narrow molecular weight ranges. An aqueous solution containing dextran of a molecular weight range of 50,000 to 200,000 has been successfully used in this process.

A second exemplary coolant is an aqueous solution of glycol. Glycols are organic dihydric alcohols, including for example ethylene glycol, and propylene glycol. Glycols are commonly used in commercial antifreeze solutions. The glycol solutions, when used in accordance with the present process, have the ability of cooling and freezing the water trapped in the biofilm before they themselves reach the water and prevent freezing. The glycols are used as aqueous solutions for obvious economical reasons.

The coolant is passed through the fouled system at a temperature sufficient to freeze the biofilm water in such a manner that cooling of the biofilm proceeds at a rate of between about 2° and 15° C./min., and more preferably at between about 4° to 7° C./min.

Once the biofilm freezing is accomplished, biofilm removal is achieved by simply resuming fluid flow in the system. Several cyclings of freezing and thawing may be used to completely remove the biofilm.

The invention is further exemplified and supported by the following examples.

EXAMPLE I

This example demonstrates that slow freezing of the biofilm to generate large sharp-edged crystals will result in disruption of the fibrous matrix with the result that it can be successfully washed away after thawing.

The example was conducted in a 1 inch diameter length of copper tubing having a plurality of removable plugs in its walls. The end of the plug, when in place in the tubing, formed a portion of the inner wall of the tubing. The plugs could be aseptically removed to provide a sample of the inner wall of the tubing.

The tubing, together with the plugs, was fouled by flowing water, containing a culture of bacteria characteristic to an industrial water system, therethrough for 48 hours. The water was flowed through the tubing at a flow rate of 138.5 cm/sec.

The frictional resistance ($f_F$) to flow was measured before and after fouling. Frictional resistance, or friction factor, is defined as follows:

$$f_F = \frac{2.0D\Delta P}{L\bar{v}^2\rho}$$

where

D = tubing diameter

L = tubing length

ΔP = pressure drop across tubing length

ρ = fluid density v = mean velocity of fluid

Measurements showed an increase in $f_F$ from 0.050 to 0.094 after 86 hours of fouling. This corresponds to a biofilm buildup of 300 μm.

The tubing was then cooled to −8° C., by packing dry ice therearound. Cooling was performed at a rate of about 4° C./min., without water flow. The tube was then allowed to thaw. Water flow was resumed immediately after thawing. The friction factor $f_F$ was then re-measured.

Comparison of the $f_F$ data (FIG. 1) indicates that the first freeze-thaw cycle was sufficient to reduce $f_F$ from 0.094 to 0.078. The tubing was then refouled to obtain an $f_F$ value of 0.086 at 114 hours. A second freeze-thaw cycle returned the $f_F$ value to 0.063 which corresponds to a biofilm thickness of only 45 μm.

Figure 2:
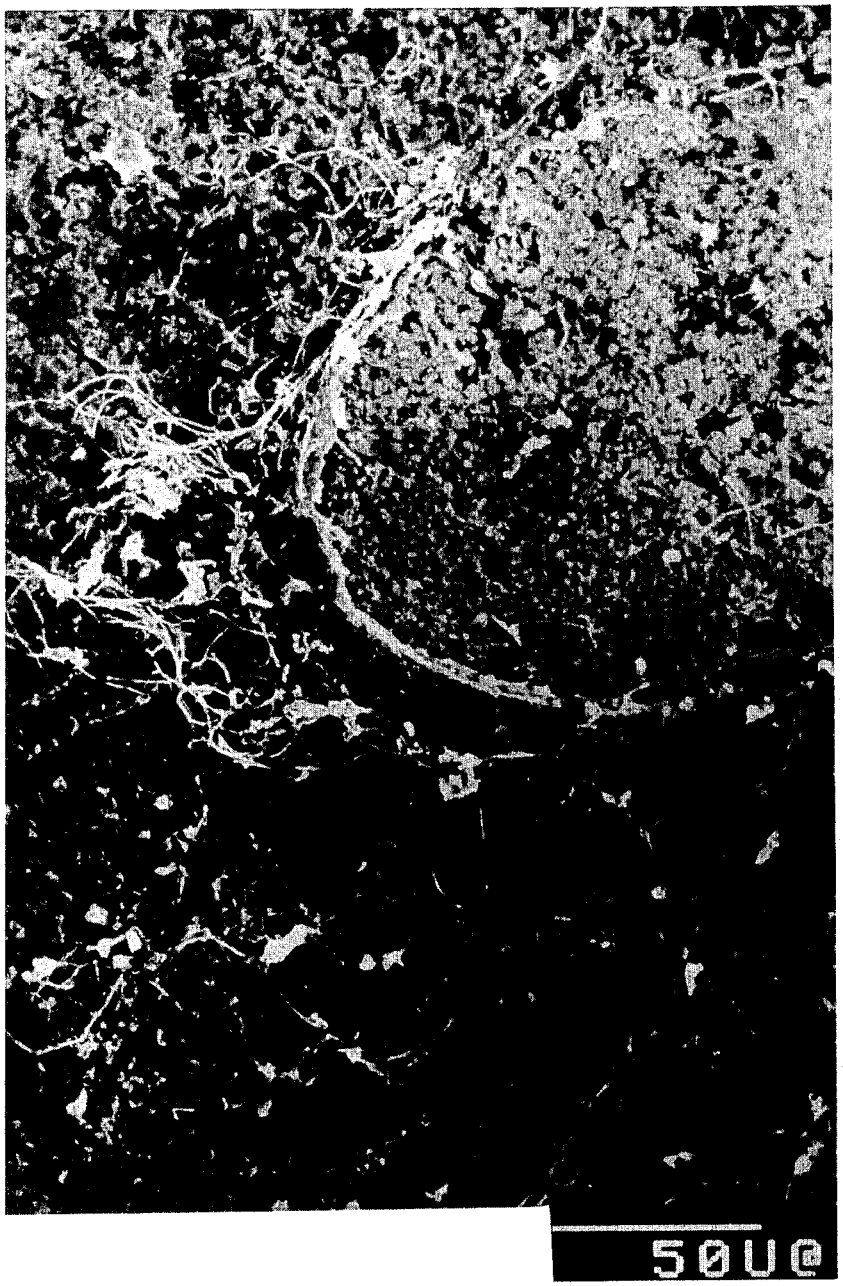
FIG. 2 is a micrograph taken by scanning electron microscopy, showing biofilm removal from a fouled surface after the freeze-thaw process of Example II.

Examination of the cleaned tubing surface (the plugs) by scanning electron microscope showed removal of the biofilm in a blister-like pattern (see FIG. 2). Crystalline deformities in the residual biofilm indicated that ice crystals between 0.5 and 20 μm had been formed by the slow freezing process.

EXAMPLE II

This example demonstrates that the rate of freezing influences the nature of the ice crystals developed in the biofilm and, in turn, affects the degree of effectiveness of biofilm removal.

A length of tubing having sampling plugs as in Example I was fouled with a culture of acquatic bacteria until an accumulation of about 150 μm of biofilm was present. The tubing was then frozen, at varying rates, by placing varying amounts of dry ice or liquid nitrogen in troughs surrounding the tubing. The temperature was measured at a plug located in the central portion of the tubing. The friction factor $f_F$ was measured before and after the freeze-thaw cycle.

The results for varying freezing rates are presented in Table I. As indicated, freezing rates of about 2° to 15° C./min. are most effective in removing the biofilm. The optimum rate of freezing was about 7° C./min. Freezing rates greater than about 20° C./min. were less effective in removing biofilm, at least in one freeze-thaw cycle.

TABLE I

| Freezing Rate* in °C./min. | Initial $f_F$ | $f_F$ after freeze-thaw | $\Delta f_F$ |
|---|---|---|---|
| 2.15 | 0.071 | 0.061 | −0.010 |
| 4.63 | 0.070 | 0.058 | −0.012 |

TABLE I-continued

| Freezing Rate* in °C./min. | Initial $f_F$ | $f_F$ after freeze-thaw | $\Delta f_F$ |
|---|---|---|---|
| 6.80 | 0.074 | 0.055 | −0.019 |
| 11.15 | 0.071 | 0.062 | −0.009 |
| 14.76 | 0.071 | 0.063 | −0.008 |
| 20.32 | 0.073 | 0.071 | −0.002 |
| 26.18 | 0.074 | 0.068 | −0.006 |
| 28.07 | 0.071 | 0.070 | −0.001 |

*the freezing rate was not constant throughout the process but was calculated by the Δt divided by the time required to reach it using combinations of dry ice and liquid $N_2$. At lower temperatures the freezing rates would not be uniform in all parts of the pipe.

EXAMPLE III

This example demonstrates that a liquid coolant such as aqueous dextran, which remains liquid below 0° C., and which does not significantly displace the water contained in the glycocalyx, may be used in the practice of this process.

A length of tubing having sampling plugs as described in Example I was extensively fouled by circulating oil-field water therethrough until the friction factor, $f_F$, had increased from 0.056 to 0.074. The oil field water was used as it provided a rapid and reliable buildup of biofilm. Once the tubing surface had been fouled, the circulating water was replaced with a saturated aqueous solution of bacteriological dextrin (a dextran $(C_6H_{10}O_5)_x$ of molecular weight 50,000 to 200,000 obtained from Fisher Scientific, Calgary, Alberta, under the catalogue number Fisher-1297) that had been cooled to −8° C. A thermocouple placed on the surface of one of the tubing studs indicated that that section of the tubing reached −7.8° C. at a rate of about 8.18° C./min. The dextran coolant was left in the tubing without flow for 3 min. The pump was then restarted and the coolant was replaced with the oil-field water.

Within 5 minutes of water replacement and flow, the $f_F$ had decreased to 0.056. This represents a $\Delta f_F$ of 0.018 and a return to the original friction factor of the prefouled tubing.

It should be pointed out that as in Example II, the freezing rate was not constant throughout the process, but was calculated by the change in temperature divided by the time required to effect the temperature change. The freezing rate would not be constant throughout the length of the tubing.

EXAMPLE IV

This example demonstrates that a liquid coolant such as an aqueous solution of a glycol, which remains liquid well below 0° C., may be used in the practice of this process. A 50% aqueous solution of ethylene glycol was used in this example.

Figure 3:
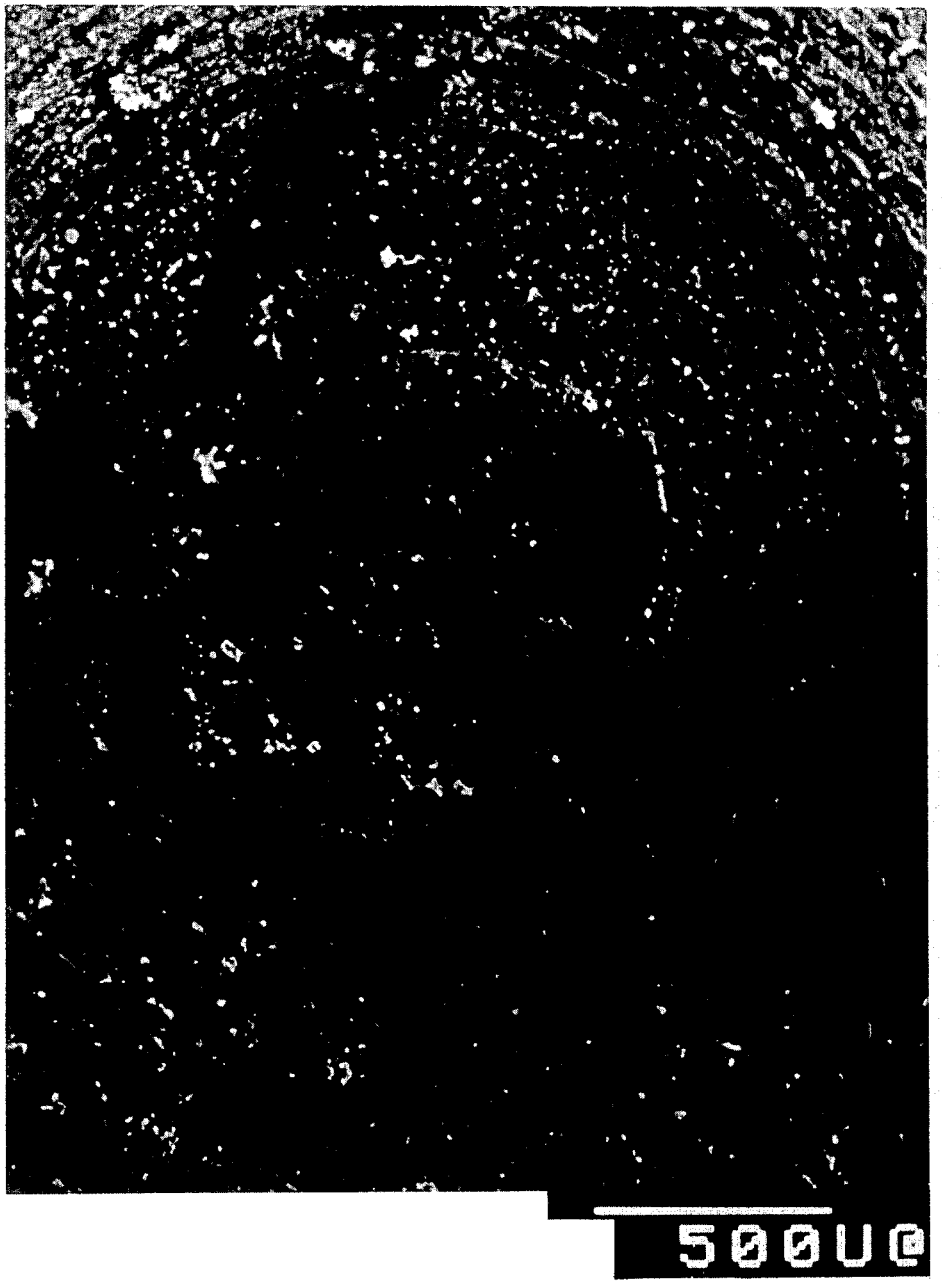
FIG. 3 is a scanning electron microscopy micrograph showing a removable section of a pipe surface prior to fouling.
Figure 4:
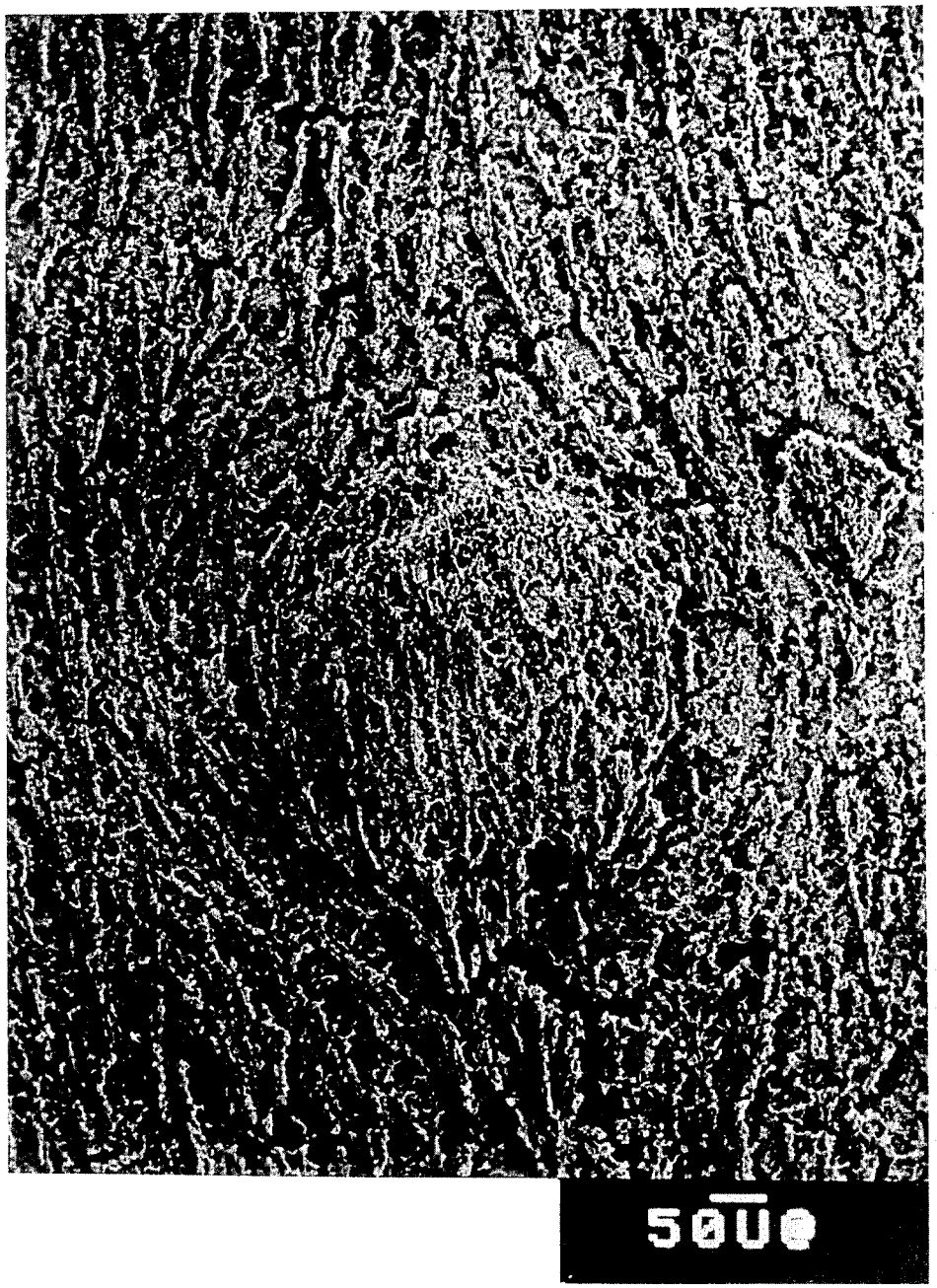
FIGS. 4 and 5 are scanning electron microscopy micrographs showing the pipe surface of FIG. 3 after fouling with sewage water for 72 and 192 hours respectively. The machine markings of the surface are obscured by the biofilm buildup. Flow retarding "tufts" of biofilm have built up.
Figure 5:
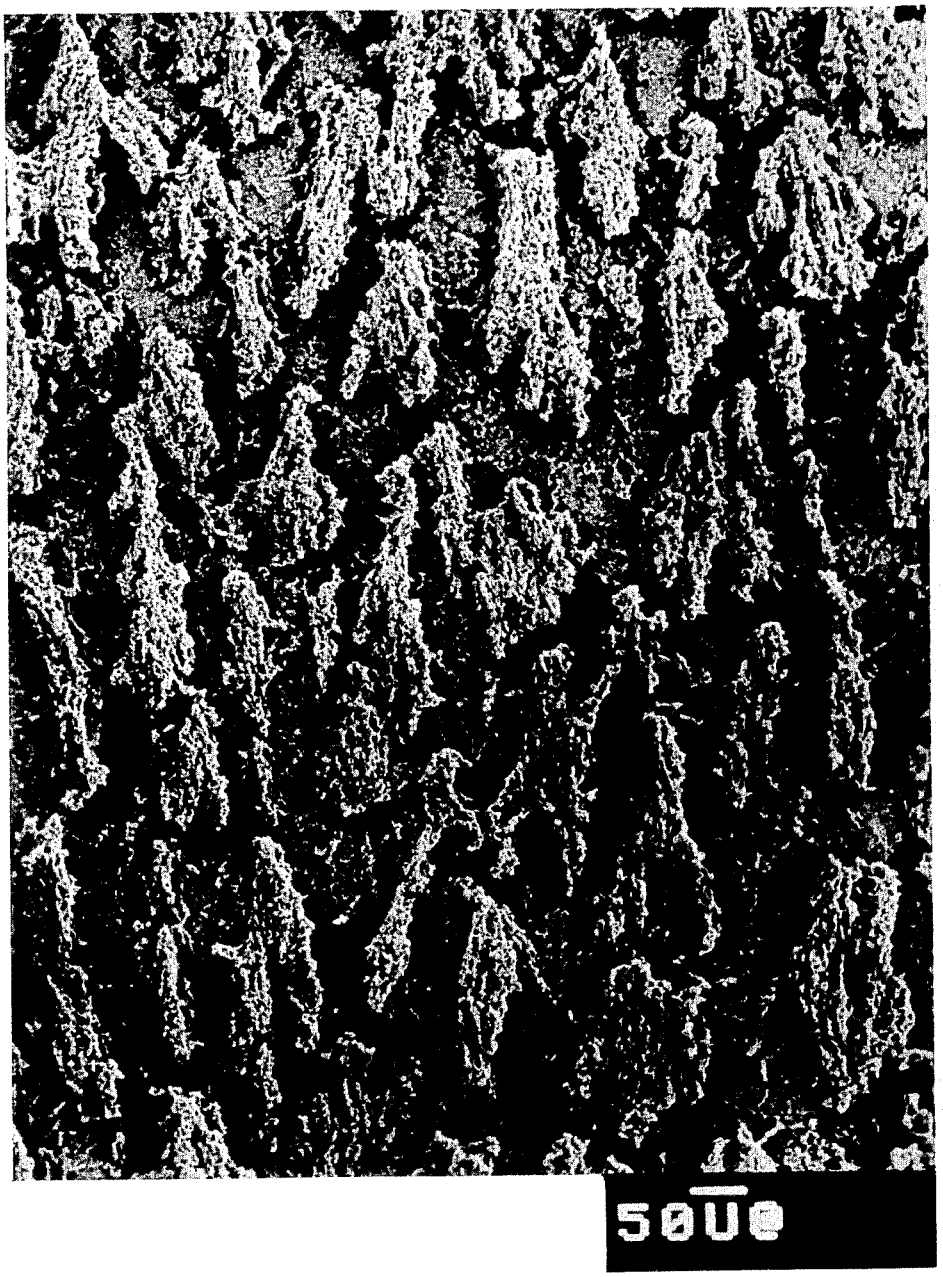

A length of tubing having multiple sampling plugs as described in Example I was very extensively fouled by circulating sewage water therethrough for 192 hours until the friction factor, $f_F$, had increased from 0.030 to 0.087. This comprises an increase of 290% and scanning electron micrographs (FIGS. 3 to 5) indicate that the stud surfaces were so extensively fouled that machine marks on their surfaces were no longer visible.

The circulating water was replaced by a 50% solution of ethylene glycol that had been cooled to −11° C. and introduced into the system by slow gravity flow. After 10 minutes the internal fluid temperature was −9° C. and the pipe wall temperature was −5° C. The pipe was refilled with sewage water and it returned to 18° C. in 30 minutes. The pipe was cooled to the same extend using 50% ethylene glycol at −15° C., and was then thawed to 18° C. The freeze-thaw cycle was repeated a third time using 50% ethylene glycol at −19° C. The freezing steps took 6 and 5 minutes respectively. Thus the cooling rates were 2.7, 4.5 and 5.4 C.°/minute for each of the sequential freezing treatments.

Figure 6:
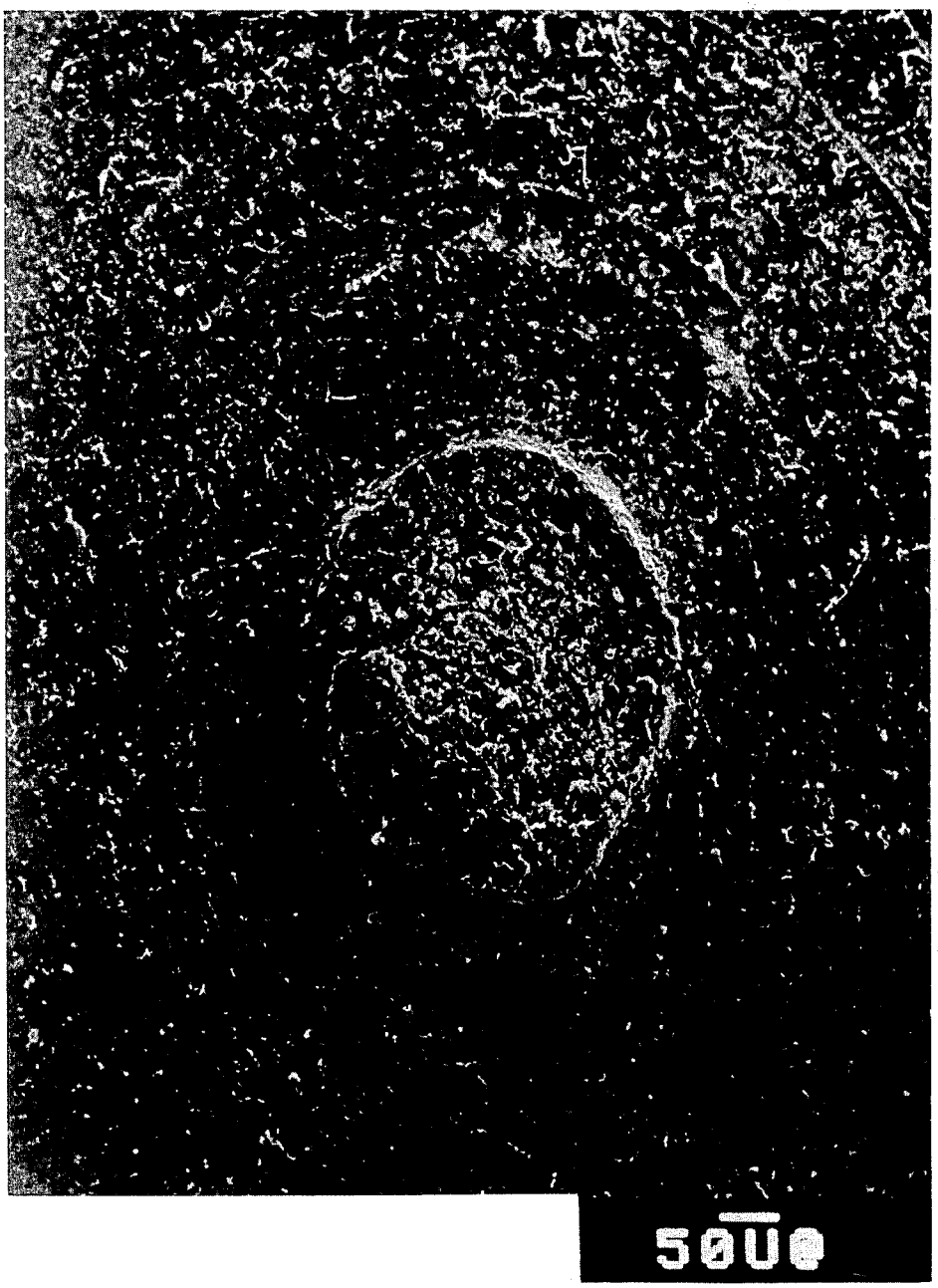
FIG. 6 is a scanning electron microscopy micrograph of the pipe surface of FIGS. 4 and 5 after three freeze-thaw cycles with an ethylene glycol coolant as described in Example III. The pipe surface detail is visible and biofilm removal has returned water flow to normal.

Within 2 minutes of the resumption of flow in the treated system the $f_F$ had returned to 0.030. This represents a $\Delta f_F$ of 0.057 and a return to the original friction factor of the unfouled tubing. Scanning electron micrographs (FIG. 6) clearly indicated that the fouling biofilm had been almost completely removed.

It should be pointed out that, as in Examples II and III, the freezing rate was not constant throughout the process, but was calculated by the change in temperature divided by the time required to effect the temperature change. The freezing rate would not be constant throughout the length of the tube.

The embodiments of the invention in which an exclusive property or privilege is claimed are defined as follows:

1. A method for removing biofilm from a submerged fouled surface in an industrial aquatic conduit, said biofilm comprising bacteria associated with glycocalyx containing water, said biofilm being adherent to the surface, which comprises:

cooling the biofilm to below the freezing point of water to thereby generate large sharp-edged ice crystals;

thawing the frozen biofilm;

and then removing at least part of the biofilm from the surface.

2. The method as set forth in claim 1 wherein:

cooling is conducted internally of the conduit by passing a coolant therethrough;

and at least part of the biofilm is removed by liquid flow across the surface.

3. The method as set forth in claim 2 wherein:

cooling is conducted at a rate within the range of 2° C. per minute to 15° C. per minute.

4. The method as set forth in claim 1 wherein:

cooling is conducted at a rate within the range of 2° C. per minute to 15° C. per minute.

5. A method for removing biofilm on the surface of a heat exchanger normally exposed to water flow, said biofilm comprising bacteria associated with glycocalyx containing water and adhering to said surface, which comprises:

slowly cooling the biofilm to below the freezing point of water to thereby generate large sharp-edged ice crystals;

thawing the frozen biofilm;

and then removing at least part of the biofilm by liquid flow across the surface.

6. The method as set forth in claim 2 wherein:

cooling is conducted at a rate within the range of 2° C./min. to 15° C.

7. The method as set forth in claim 6, wherein:

cooling is conducted internally of the heat exchanger using a coolant which is liquid below 0° C. and does not significantly displace the water contained in the biofilm.

8. The method as set forth in claim 7 wherein:

cooling is performed with a coolant comprising an aqueous solution of dextran.

9. The method as set forth in claim 7 wherein:

cooling is performed with a coolant comprising an aqueous solution of a glycol.

10. The method as set forth in claim 7 wherein:

cooling is performed with a coolant comprising an aqueous solution of ethylene glycol.

* * * * *